United States Patent [19]

Gismondo et al.

[11] Patent Number: 5,053,674

[45] Date of Patent: Oct. 1, 1991

[54] TENSIONED FOIL SHADOW MASK MOUNTING

[75] Inventors: Alfio J. Gismondo, West Dundee; Miguel A. Perez, Lake Villa; Ramiro I. Sanchez, Chicago, all of Ill.

[73] Assignee: Zenith Electronics Corporation, Glenview, Ill.

[21] Appl. No.: 566,644

[22] Filed: Aug. 13, 1990

[51] Int. Cl.[5] ..... H01J 29/07; H01J 9/02

[52] U.S. Cl. ..... 313/407; 445/30; 445/37

[58] Field of Search ..... 313/402, 407, 408; 445/30, 37, 47

[56] References Cited

U.S. PATENT DOCUMENTS

| | | | |
|---|---|---|---|
| 4,737,681 | 4/1988 | Dietch et al. | 313/402 |
| 4,767,962 | 8/1988 | Adler et al. | 313/402 |
| 4,778,427 | 10/1988 | Strauss | 445/30 |
| 4,804,881 | 2/1989 | Strauss | 313/407 |
| 4,834,686 | 5/1989 | Kautz et al. | 445/30 |
| 4,866,334 | 9/1989 | Fendley et al. | 313/407 |
| 4,891,028 | 1/1990 | Kautz et al. | 445/30 |

*Primary Examiner*—Sandra L. O'Shea

[57] ABSTRACT

A generally rectangular mounting structure for attaching a tensioned foil shadow mask to the flat glass faceplate of a color cathode ray tube (CRT) includes four rails attached at respective ends thereof by means of four corner brackets spot welded to adjacent ends of a pair of rails. Each of the four corners of the rail structure is coated with a frit-based sealant to hermetically seal the corner bracket-rail interface, followed by baking, to prevent the collection of contaminants such as phosphor particles which heretofore collected in gaps between the corner bracket and rail only to later escape and cause CRT rejection or failure.

11 Claims, 4 Drawing Sheets

TENSIONED FOIL SHADOW MASK MOUNTING

BACKGROUND OF THE INVENTION

This invention relates generally to cathode ray tubes (CRTs) and is particularly directed to color CRTs having a tensioned foil shadow mask attached to a flat glass faceplate.

CRTs having a flat faceplate with a flat tensioned foil shadow mask offer various advantages over conventional color CRTs of the curved shadow mask and faceplate type including greater picture brightness. The tensioned foil shadow mask is maintained in a stretched condition by securely attaching it to a generally rectangular mounting structure which is typically affixed to the inner surface of the flat glass faceplate. Maintaining the shadow mask in a tightly stretched condition ensures proper alignment of shadow mask apertures with phosphor elements disposed on the faceplate's inner surface. The phosphor elements are typically deposited on the faceplate by pouring a phosphor slurry on the faceplate's inner surface which is covered by a template to ensure proper positioning of the discrete phosphor elements thereon for each of the three primary colors. Following baking of the phosphor coated faceplate, excess phosphor is removed such as by washing, and CRT assembly continues.

The shadow mask mounting structure is typically in the form of four rails joined at respective adjacent ends thereof by corner brackets to form a generally rectangular support structure. The rails and brackets are generally metal and are attached by spot welding. A frit-based cement is used to affix the shadow mask mounting structure to the faceplate's inner surface. In the past, the shadow mask mounting structure has been a source of contamination as phosphor particles collect in the corners of the rail structure in gaps between the corner brackets and connected rails. These phosphor deposits remain after the excess phosphor is washed from the CRT front panel and later seep out from the gaps in the corner bracket-rail structure during subsequent CRT assembly. The phosphor particles which thus reappear represent a serious contaminant which frequently result in rejection or failure of the CRT. These contaminating phosphor particles may be deposited on the rail structure and prevent secure attachment of the tensioned foil shadow mask to its mounting structure. The loose phosphor particles may also be deposited upon the shadow mask and become lodged in its apertures. In either case, video image quality will be impaired. These charged phosphor particles may also come in contact with an electron gun and short it out. Attempts to remove phosphor particles by scrubbing the corners of the shadow mask mounting structure at various stages during CRT assembly have been labor intensive and thus costly, and have met with only limited success.

This invention addresses the aforementioned limitations of the prior art in the manufacture of color CRTs having flat glass faceplates and tensioned foil shadow masks by hermetically sealing the corner joints of the shadow mask mounting structure attached to the faceplate to prevent the collection of phosphor particles and their later discharge during subsequent CRT processing or operation.

OBJECTS OF THE INVENTION

Accordingly, it is an object of the present invention to provide an improved attachment arrangement for a tensioned foil shadow mask in a color CRT.

It is another object of the present invention to provide a hermetically sealed mounting structure for a tensioned foil shadow mask in a color CRT which prevents the collection and discharge of contaminants during subsequent CRT assembly or after the CRT is sealed following manufacture.

A further object of the present invention is to provide for more efficient and effective assembly of CRTs resulting in reduced manufacturing time and cost and fewer rejects.

Yet another object of the present invention is to reduce the possibility of phosphor particle contamination in a color CRT during assembly.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENT

The following discussion as it relates to FIGS. 1, 2 and 3*a* and 3*b* describes one approach to affixing a tensioned foil shadow mask to its support structure as described and claimed in co-pending application Ser. No. 460,037, filed Jan. 2, 1990 now U.S. Pat. No. 5,013,273, and attaching a tensioned foil shadow mask support structure to a CRT flat glass faceplate as described and claimed in U.S. Pat. No. 4,737,681, issued Apr. 12, 1988, both assigned to the assignee of the present application. This description is provided to more completely set forth the environment in which the improved tensioned foil shadow mask mounting of the present invention is intended for use and does not represent a limitation of this invention which is independent of the manner or means in which the shadow mask is mounted to its support structure or the support structure is affixed to a CRT glass faceplate. The aforementioned co-pending patent application and issued patent are hereby incorporated by reference in the present application.

Figure 1:
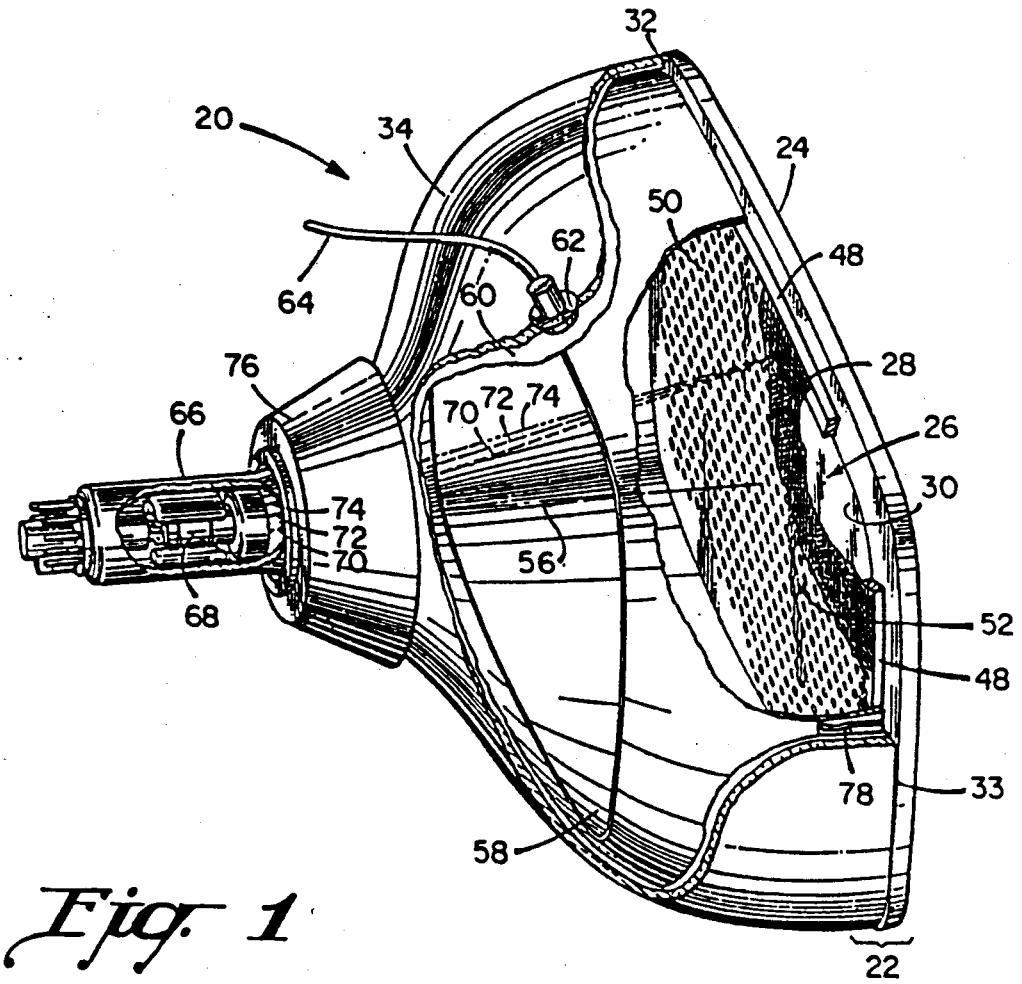
FIG. 1 is a side view in perspective shown partially cutaway of a color CRT having a flat faceplate and a tensioned foil shadow mask in which the improved tensioned foil shadow mask mounting of the present invention is intended for use.

The color CRT 20 illustrated in FIG. 1 includes a flat faceplate 24 positioned upon and securely mounted to the forward edge portion of a funnel 32. The flat faceplate 24 and the funnel 32 are comprised of glass, with the enclosed structure thus formed evacuated by conventional means (not shown) after various electronic components are positioned therein and the structure is then sealed. Positioned within a neck portion 66 of the funnel 32 is an in-line electron gun 68 which is aligned with the anterior-posterior axis of the CRT designated by the numeral 56. The in-line electron gun 68 emits a plurality of electron beams 70, 72 and 74 which are directed through apertures 52 in a tensioned foil shadow mask 50 which is maintained under high tension and is closely spaced relative to the inner surface 26 of the faceplate 24. A magnetic deflection yoke 76 is positioned about the funnel's neck 66. Horizontal and vertical deflection currents are provided to the magnetic deflection yoke 76 for deflecting the three electron beams in a timed manner across the CRT's faceplate 24.

A high voltage electron accelerating potential is applied from a power supply (not shown) via a conductor 64 to an anode button 62 on the CRT's funnel 32. The anode button 62 extends through the CRT's funnel 32 and is in electrical contact with an internal conductive coating 60 on the inner surface of the funnel 32. A contact spring 78 is electrically coupled to the internal conductive coating 60 and is further coupled to the shadow mask 50 such as by means of weldments. Electrical contact is also established between the shadow mask 50 and a metal cap (not shown) on each of four rails which are used for mounting and positioning the shadow mask within the CRT 20 as described in detail below. Disposed on the inner surface of the CRT's glass faceplate 24 is a film of reflective and electrically conductive aluminum 30. Mounted to the faceplate and positioned between the reflective and conductive aluminum 30 and the shadow mask 50 is a phosphor screen 28 responsive to electrons incident thereon for emitting light to form a video image.

Figure 2:
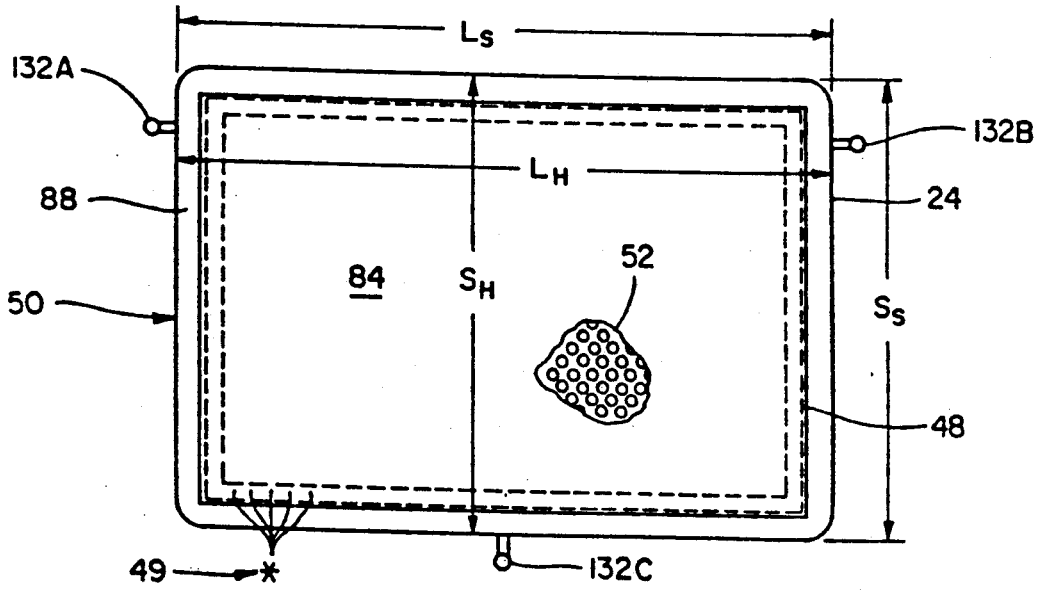
FIG. 2 is a plan view of the front assembly of the CRT shown in FIG. 1 as seen from the electron gun end of the CRT depicting the relationship of the tensioned foil shadow mask and faceplate of FIG. 1 and which includes an inset illustrating shadow mask apertures greatly enlarged.

Referring to FIG. 2, there is shown a partially cutaway plan view of the CRT 20 of FIG. 1 illustrating details of the manner in which the shadow mask 50 is positioned upon and mounted to the CRT's faceplate 24. The manner in which the shadow mask 50 is positioned upon and mounted to the CRT's faceplate 24 as shown in FIGS. 1 and 2 is provided herein to set forth the environment in which the present invention is intended for use and does not represent a limitation of the present invention. The shadow mask 50 includes a central field 84 having a plurality of electron-beam-passing apertures which are illustrated, in greatly enlarged size, in the inset 52 of the shadow mask. The shadow mask support structure 48 is generally rectangular in shape and is comprised of four elongated, linear members, each of which is coupled at one end thereof to another elongated, linear support structure element by means of a corner bracket (not shown). The shadow mask support structure 48 is typically comprised of steel, such as stainless or rolled steel. The shadow mask 50 is securely attached to the aft surface of the shadow mask support structure 48 by weldments identified by number 49 around its periphery. Where the shadow mask support structure 48 is comprised of a ceramic material, the shadow mask 50 may be affixed to the support structure by means of a glass sealing frit cement which is also used to mount the shadow mask support structure 48 to the CRT's faceplate 24. A plurality of removable ball assemblies 132A, 132B and 132C are disposed about the periphery of the shadow mask 50 and are part of a ball-and-groove indexing system for registering the faceplate 24 during manufacture. An arrangement for mounting the shadow mask 50 illustrated in FIGS. 1 and 2 is described and claimed U.S. Pat. No. 4,767,962, issued Aug. 30, 1988, also assigned to the assignee of the present application.

In one embodiment, each of the rails is connected to two adjacent rails by means of a corner coupling bracket (not shown, but described in detail below) attached to an outer edge portion of each of the rails for securing the shadow mask 50 by weldments to its support structure 48. The corner coupling brackets may be fastened to an end of each of the rails of the shadow mask support structure 48 by means of a suitable cement or by spot welding in a conventional manner. The foil shadow mask is maintained in a stretched manner under high tension in position adjacent to the phosphor screen 28 on the rear surface of the faceplate 24.

The electron-beam-passing apertures for an ultra-high resolution cathode ray tube may have a diameter on the order of 0.003 inch, by way of example. The shadow mask's central field 84 is indicated as being enclosed by a peripheral outer band 88 of solid metal. Outer band 88 serves two purposes: (1) it provides a surface for gripping the blank during the expanding of the blank in tensioning; and (2) it provides an area for affixing the mask to its underlying support structure 48, indicated by the dashed lines. As has been noted, the shadow mask support structure 48 serves for mounting and securing the shadow mask. Securing of a shadow mask to its support structure is preferably accomplished by a large number of weldments disposed about the shadow mask where it engages its support structure. Where laser weldments are employed, the laser is typically operated at a peak output power of approximately 300 watts. After welding, the excess material of the outer band 88 is trimmed off along the outer edge of the dashed line that indicates the underlying support structure 48. The aforementioned co-pending application Ser. No. 460,037 is directed to a continuous laser welding method for attaching the shadow mask.

Figure 3A:
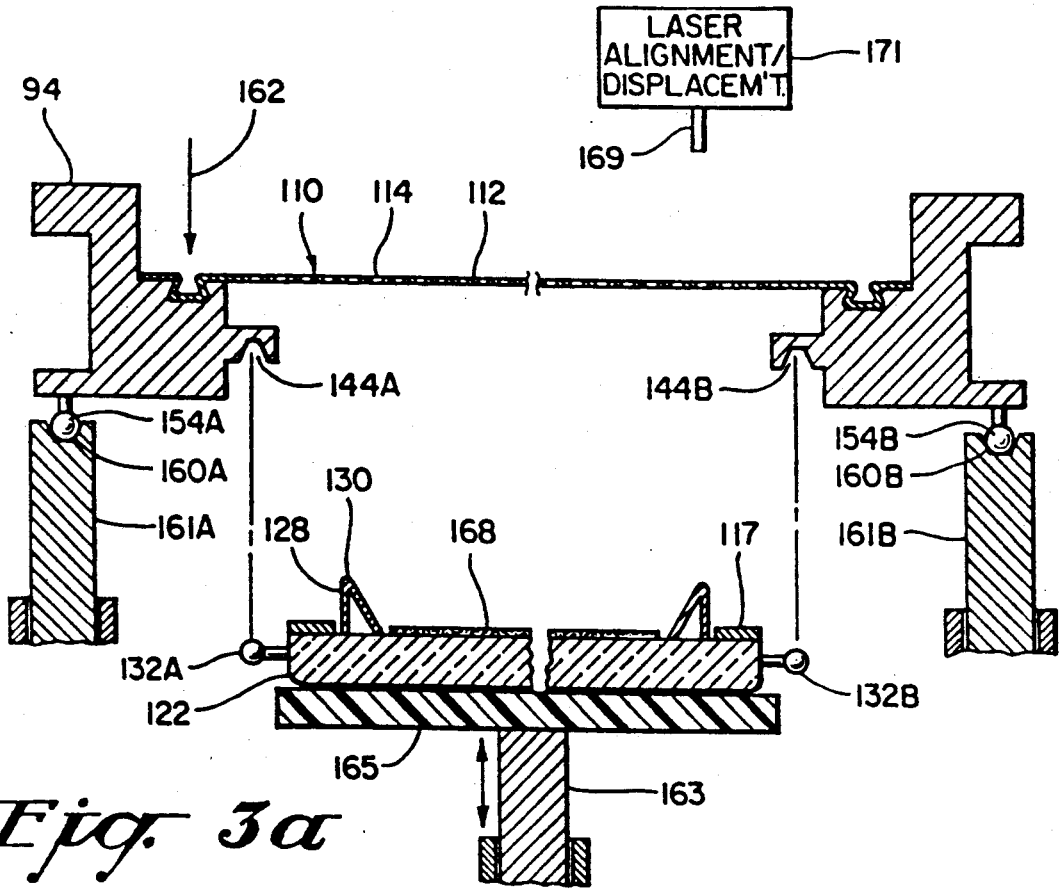
FIGS. 3*a* and 3*b* are sectional views illustrating details of an arrangement for precisely registering a shadow mask factory fixture frame with means for mask welding and severing the shadow mask.
Figure 3B:
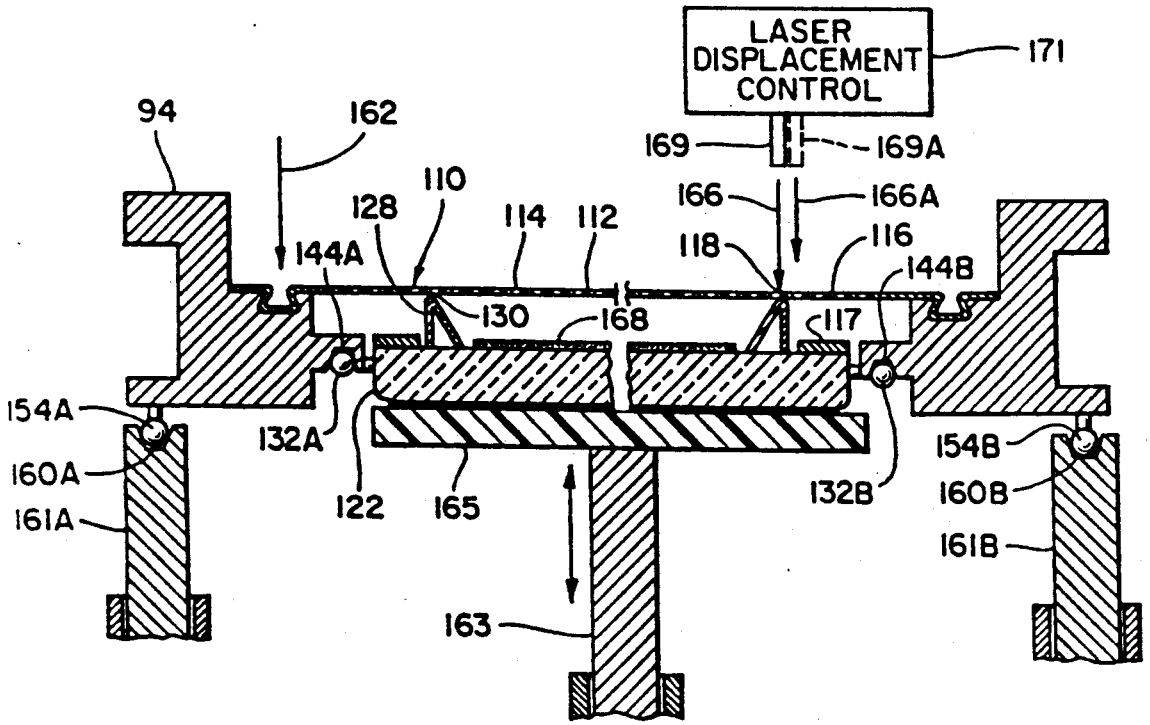

Referring to FIGS. 3*a* and 3*b*, there is shown an arrangement for mounting an in-process shadow mask 110 on a mask support structure 128. The shadow mask 110 comprises a center field 112 of apertures intended for the color selection function in a completed color CRT. Center field 112 is indicated as being enclosed by a border 114 of unperforated metal which is severed as described below from the center field 112 in a later operation along a sever line.

The shadow mask 110 is positioned upon and attached to a vertically moveable factory fixture frame 94. The clamping of the in-process shadow mask 110 is indicated schematically by arrow 162. An in-process faceplate 122 is depicted as resting on a carriage 165, indicated symbolically as comprised of plastic. A plastic softer than the glass of the faceplate is preferred as a material for carrying the faceplate to avoid scratching or other abrasion of the surface.

As indicated by the associated arrow, carriage 165 can be raised and lowered by a pneumatic piston 163, depicted in FIG. 3*a* as being in the lowered position, and in FIG. 3*b* as being in the raised position.

A shadow mask indexing arrangement for properly aligning the shadow mask 110 with the faceplate 122 includes a pair of ram heads 161A and 161B, in conjunction with a third ram head which is not shown in the figures for simplicity. FIG. 3*a* shows the ram heads 161A and 161B as having lifted the factory fixture frame 94.

The shadow mask-faceplate registration arrangement includes a plurality of indexing ball means 154A and 154B in combination with complementary indexing means in the form of grooves 160A and 160B located atop respective ram heads 161A and 161B. The ram heads 161A and 161B are in turn mounted on a separate platform (not shown) and are raised in unison to engage respective indexing ball means 154A and 154B located on a lower portion of factory fixture frame 90.

As shown in FIG. 3*b*, the faceplate 122 has been lifted by piston 163 into exact registration with factory fixture frame 94 and with the in-process shadow mask 110 held in tension therein. The shadow mask 110 is maintained under tension within the factory fixture frame 94 by clamping as indicated previously, with the details of such clamping arrangement not shown in the figures for simplicity. The means of registration of the faceplate 122 with the factory fixture frame 94 are indicated as comprising a plurality of ball means 132A and 132B (with a third ball means not shown for simplicity) that extend from faceplate 122 with groove means 144A and 144B from the factory fixture frame 94. The mask receiving surface 130 of the shadow mask support structure 128 is indicated in FIG. 3*b* as being in intimate, uniform contact with the in-process shadow mask 110. It is essential for proper welding that the mask-receiving surface 130 of the shadow mask support 128 be absolutely clean and unoxidized. As described above, prior to the present invention phosphor particles have become lodged in cracks, or gaps, in the corners of the support structure 128 only to later become dislodged and deposited on the mask-receiving surface 130 of the shadow mask support. The shadow mask 110 could as well be in a negative interference relationship with the mask-receiving surface 130 of the shadow mask support structure 128 until the time of welding the mask to the mask support, as described in U.S. Pat. No. 4,778,427 of common ownership herewith.

The in-process shadow mask 110, while still clamped in tension in the factory fixture frame 94, is welded to the mask receiving surface 130 of the shadow mask support structure 128 by a laser beam 166 emitted by a laser 169. The laser 169 is coupled to and displaced by a laser displacement controller 171 which may be conventional in design and operation. One example of a laser welding positioning and displacement arrangement which could be employed in the present invention can be found in U.S. Pat. No. 4,834,686 to Kautz et al. Upon completion of the welding of the shadow mask 110 to the support structure 128, the laser 169 is moved outwardly toward a peripheral edge of the shadow mask and the border 114 of unperforated metal of the shadow mask 110 is severed at the line of severance 116 by a severing laser beam as indicated by the arrow 166A in FIG. 3*b* and a new position of the laser at 169*a*.

To prevent damage to the faceplate-funnel sealing area from the laser beam during the severing process, a shield 117 may be laid over the sealing area as disclosed and claimed in U.S. Pat. No. 4,891,028, assigned to the assignee of the present application. Shield 117 may comprise material that reflects the laser radiation and is not damaged by the beam. A suitable material is aluminum having a thickness of at least 5 mils. Upon completion of the severing operation, the in-process shadow mask 110, now firmly welded to the mask receiving surface 130 of the shadow mask support structure 128, is free of the factory fixture frame 94, and the assembly has become a viable faceplate assembly complete with a phosphor-bearing screen 168, and is ready for attachment to a funnel. Attachment of the faceplate assembly to the forward portion of the funnel may be performed by conventional means such as clamping in combination with application of a frit-based adhesive and sealing material.

Figure 4:
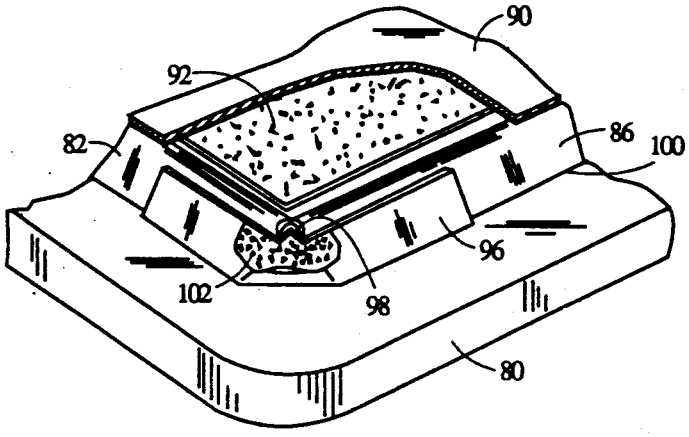
Fig. 4 PRIOR ART
FIG. 4 is a perspective view shown partially cutaway of a portion of a prior art tensioned foil shadow mask mounting arrangement.

Referring to FIG. 4, there is shown a perspective view of a portion of a prior art tensioned foil shadow mask mounting arrangement. The prior art tensioned foil shadow mask mounting arrangment includes first and second elongated, generally linear rails 82 and 86 coupled together at adjacent ends thereof to form one corner of a generally rectangular structure. A foil shadow mask 90 is maintained in a tightly stretched condition on the mounting structure by attaching it to the upper edges of rails such as shown for the first and second rails 82, 86 in the figure. The rails 82, 86 are typically metallic as is the tensioned foil shadow mask 90, with the shadow mask securely attached to the rails by conventional means such as weldments.

Phosphor elements 92 are formed on the inner surface of the glass faceplate 80 within the area defined by the shadow mask support structure. These phosphor elements 92 are formed by depositing a slurry containing phosphor particles over a template positioned on the glass faceplate 80. This procedure is followed for each of the three primary colors. Following application of these phosphor elements, excess phosphor is removed such as by washing, although some phosphor particles generally remain after this washing as described below.

The first and second rails 82, 86 are generally A-shaped and include an open, lower portion. A frit-based cement 100 is inserted in the lower, open portion of each of the rails 82, 86 and is positioned in tight fitting engagement with a surface of the CRT's flat glass faceplate 80 as shown in the figure. The combination is then baked at a high temperature to affect curing of the frit-based cement 100. An example of attaching a tensioned foil shadow mask support structure by means of a frit-based cement can be found in the aforementioned '681 patent. This patent further describes the composition of a frit-based cement for use in attaching the first and second rails 82, 86 to the CRT's glass faceplate 80.

Adjacent ends of the first and second rails 82, 86 are provided with respective 45° edges so that the two rails form a right angle when joined. A metal corner bracket 96 is used for securely joining adjacent edges of the first and second rails 82, 86. The corner bracket 96 is also typically comprised of metal and is attached to the rails 82, 86 by conventional means such as spot welding.

Figure 5:
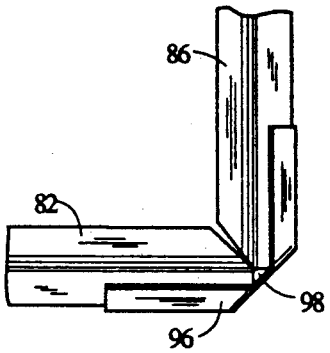
Fig. 5 PRIOR ART
FIG. 5 is a plan view of a corner portion of the prior art tensioned foil shadow mask mounting arrangement shown in FIG. 4.

When joined by means of a corner bracket 96 and attached to a glass faceplate 80 as shown in FIGS. 4 and 5, a gap 98 is formed between adjacent ends of the rails and the corner bracket. This gap, or opening, permits phosphor particles 102 to collect in the space, or gap, 98 between the first and second rails 82, 86 and the corner bracket 96 as shown in FIG. 4. Subsequent processing involving bake cycles and evacuation of the CRT draws these phosphor particles out from the space between the rails 82, 86 in the corner bracket 96 via the gap 98 therebetween as also shown in FIG. 4. These phosphor particles are contaminants within the sealed CRT. These phosphor particles, which become charged particles in an operating CRT, can short out the CRT's electron guns or become lodged in the apertures of the tensioned foil shadow mask 90 to prevent electrons from passing therethrough and degrade video image quality. In addition, the phosphor particles 102 may be deposited upon the upper edge portions of the rails 82 and 86 and prevent a secure weldment from being formed between the shadow mask and its support rail. These loose phosphor particles 102 may cause other malfunctions within an operating CRT resulting in rejection or failure of the tube.

Figure 9:
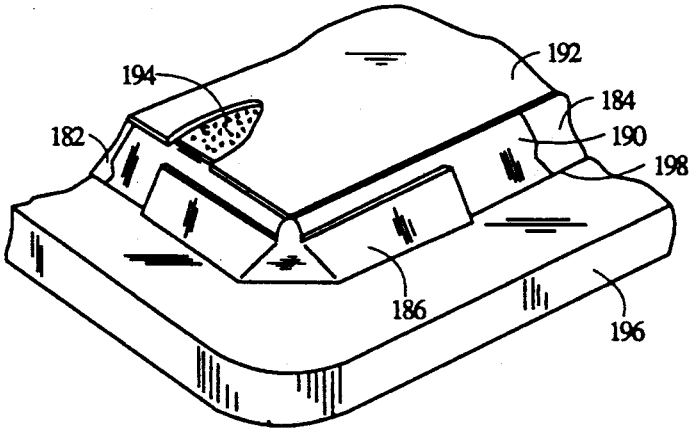
FIG. 9 is a perspective view of a corner portion of a tensioned foil shadow mask mounting arrangement in accordance with the present invention illustrating details of the manner in which the mounting arrangement is sealed to prevent phosphor particle contamination within the CRT.

Referring to FIGS. 6–9, there are shown various views of an improved tensioned foil shadow mask mounting arrangement 180 in accordance with the principles of the present invention. In the improved tensioned foil shadow mask mounting arrangement 180, the first and second rails 182, 184 are coupled together by means of a corner bracket 186, as previously described. Also, the combination of the first and second rails 182, 184 joined by the corner bracket 186 are securely affixed to a glass faceplate, or panel, 196 of the CRT by a frit-based cement 198, also as previously described and as shown in FIG. 9.

Figure 6:
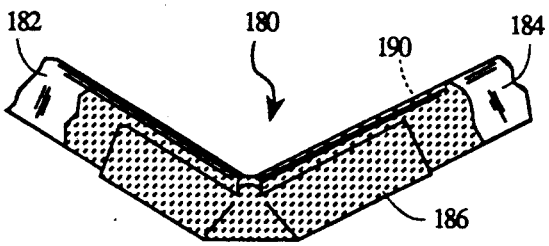
FIG. 6 is a perspective view of a corner portion of a tensioned foil shadow mask mounting structure coated with a frit-based sealant in accordance with the present invention.
Figure 7:
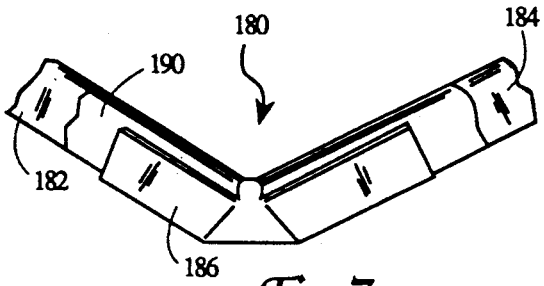
FIGS. 7 and 8 are perspective and plan views of the corner portion of a tensioned foil shadow mask mounting arrangement as shown in FIG. 6 following baking of the frit-based sealant layer thereon.
Figure 8:
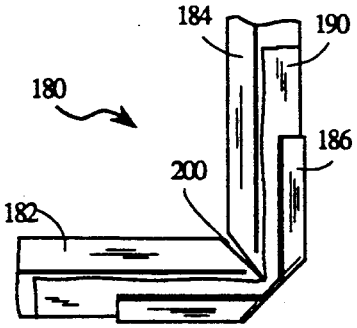

The present invention departs from the prior art in its use of a coating of a sealant 190 over the four corner portions of the tensioned foil shadow mask mounting structure. Thus, as shown in FIG. 6, a sealant 190 is deposited on the outer portions of adjacent ends of the first and second rails 182 and 184 as well as on the corner bracket 186. In a preferred embodiment, the sealant 190 is also comprised of a frit-based cement which is applied by means of a brush to the outer surfaces of the rails 182 and 184 and the corner bracket 186. As shown in FIG. 6, the frit-based sealant 190 is initially opaque, thus the dotted lines. Following baking of the frit-based sealant 190 it becomes transparent as shown in FIG. 7 while continuing to provide a continuous, sealed coating over the outer edge portion of the shadow mask mounting structure.

The coating of the sealant 190 covers and fills all gaps between the first and second rails 182, 184 and the corner bracket 186. By hermetically sealing the corner joints of the shadow mask mounting structure, phosphor particles, and other contaminants, are prevented from entering and collecting beneath and between these structures. By preventing the lodging of contaminant particles in the corner portions of the shadow mask support structure, subsequent release of such contaminant particles during later stages of CRT assembly is avoided. A gap between the first and second rails 182, 184 adjacent inner edges thereof identified as element 200 is filled by a frit-based cement 198 inserted in the V-shaped, lower portion of the rails which securely affixes the rails to the flat glass faceplate 196 as shown in FIG. 9. As shown in the perspective view of FIG. 9, the corner portions of the structure comprised of rails 182 and 184, corner bracket 186, and a tensioned foil shadow mask 192 is seamless and without any gaps or voids capable of collecting particle contaminants or other debris. A plurality of phosphor elements 194 deposited on the inner surface of the flat glass faceplate 196 is shown adjacent the partially cutaway portion of the tensioned foil shadow mask 192 in FIG. 9.

Figure 10:
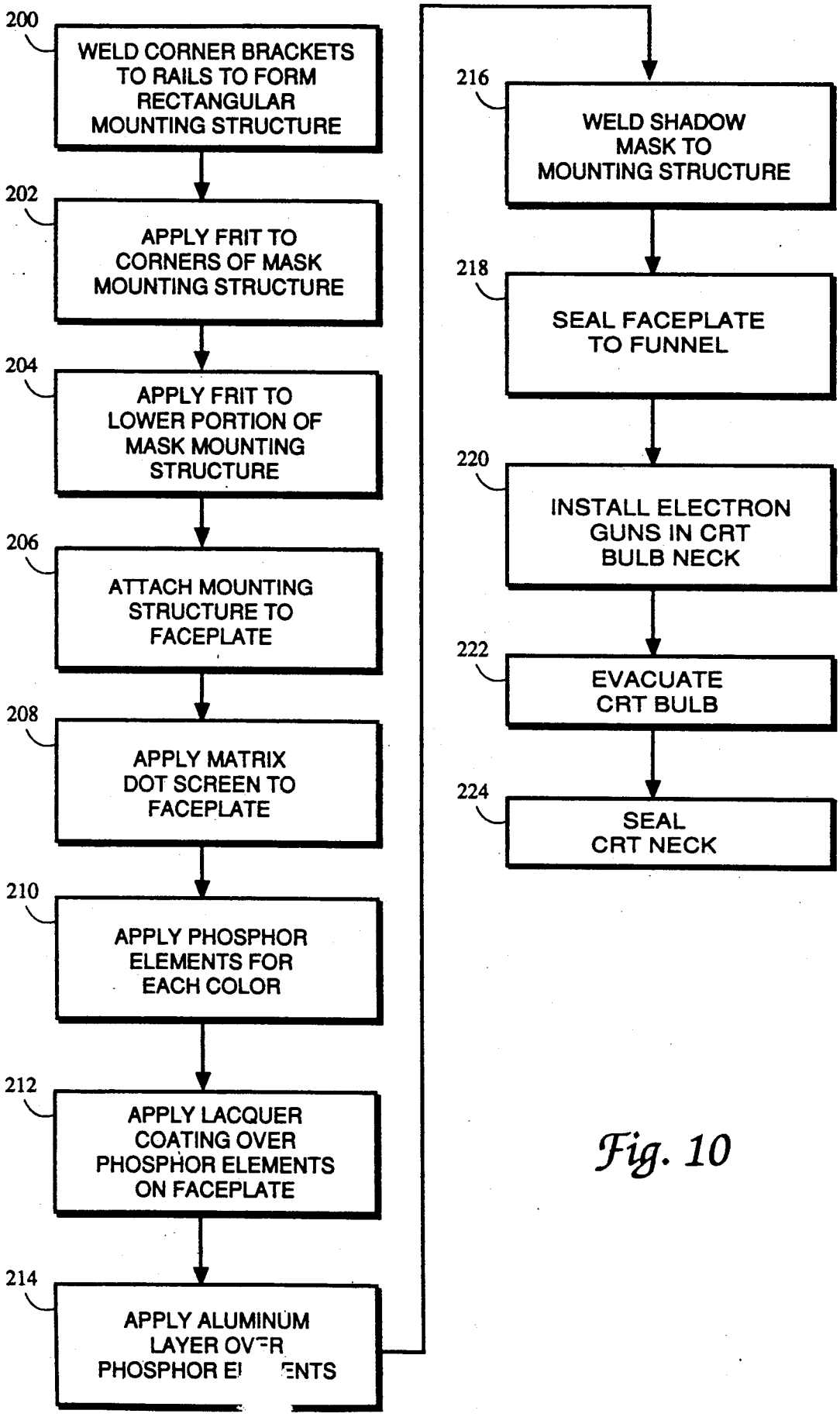
FIG. 10 is a flow diagram depicting a method of manufacture following the teachings of the present invention.

Referring to FIG. 10, there is shown a flow chart describing the sequence of operations in assembling a color CRT in accordance with the present invention. At step 200, the four corner brackets are spot welded to the four rails to form a rectangular mounting structure for receiving a tensioned foil shadow mask. The rails and corner brackets are preferably comprised of stainless or rolled steel. At step 202, a sealant such as a frit-based cement or paint is applied by brush to each of the four corners of the mask mounting structure resulting in an opaque sealed covering for the corner bracket-rail interface. The sealant is then baked onto the corner bracket-rail assembly. A frit-based cement is then applied at step 204 to the lower, V-shaped portion of each of the rails of the mask mounting structure. At step 206, the mask mounting structure is positioned on the flat glass faceplate, with the frit-based cement coating in contact with the glass faceplate as shown in FIG. 9. The assembly is then baked to form a secure, rigid bond between the mask mounting structure and the glass faceplate.

The next step in CRT assembly involves the application of a matrix dot screen to the inner surface of the glass faceplate within the rectangular shadow mask mounting structure at step 208, followed by the deposit of a phosphor slurry on this portion of the faceplate at step 210 for forming individual phosphor elements on the faceplate. This is repeated for each of the three primary colors. At step 212, a lacquer coating is applied over the phosphor elements on the inner surface of the glass faceplate, followed by the application of a conductive and reflective aluminum layer over the lacquer coating and phosphor elements at step 214.

The tensioned foil shadow mask is then securely attached to its mounting structure at step 216 such as by welding. The faceplate assembly, including the tensioned foil shadow mask and its mounting structure, is then positioned on a forward edge of a CRT funnel and is joined thereto in a sealed manner by means of a frit-based cement at step 218. An electron gun assembly is then inserted in the open, neck portion of the CRT's funnel and is maintained in position therein by appropriate support structure at step 220. The CRT bulb is then evacuated at step 222 followed by sealing of the rear, neck portion of the CRT at step 224 to provide an evacuated glass CRT bulb with various electronic components therein and provision made for electrically coupling these internal electronic components to outside signal and voltage sources.

There has thus been shown an improved tensioned foil shadc · mask mounting structure and procedure involving linear, elongated rails coupled at adjacent ends by means of four corner brackets to form a rectangular support structure. The metal rails and corner brackets are coupled by means of weldments, with gaps, or voids, typically formed between the rails and corner brackets. These gaps are filled by a sealant such as a frit-based paint or cement to provide a hermetically sealed shadow mask support structure. By thus sealing joints in the support structure, contaminants such as phosphor particles are prevented from becoming lodged in the support structure only to be later dislodged and give rise to CRT rejection, improper operation, or failure.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. For use in a color cathode ray tube (CRT), a support structure for supporting and maintaining a tensioned foil shadow mask in a tightly stretched condition, wherein various contaminants are produced during CRT assembly, said support structure comprising:

a plurality of elongated, generally linear rails;

a plurality of corner brackets each coupled to adjacent ends of a pair of rails to form a corner of a closed support structure adapted for receiving a foil shadow mask, wherein gaps tend to form between each corner bracket and its associated pair of rails; and sealant means disposed over each corner bracket and its associated pair of rails for sealing said gaps between a corner bracket and coupled rails and preventing a contaminant from becoming lodged in any such gaps.

2. The support structure of claim 1 wherein said rails and corner brackets are comprised of metal, said support structure further comprising weldments for securely coupling said corner brackets and said rails.

3. The support structure of claim 2 wherein said sealant means comprises a frit-based cement.

4. A method for assembling and installing a tensioned foil shadow mask and support structure therefor in a color cathode ray tube (CRT) having a flat galss faceplate, said method comprising the steps of:

forming a generally rectangular support structure by coupling together four elongated, generally linear rails with four corner brackets;

applying a sealant to each of said corner brackets and adjacent portions of said rails for filling and sealing any gaps formed between a corner bracket and the rails to which it is coupled to prevent a contaminant from becoming lodged in any such gaps;

attaching the support structure to the CRT's flat glass faceplate; and affixing a tensioned foil shadow mask to the support structure.

5. The method of claim 4 wherein said rails and corner brackets are comprised of metal, said method further comprising the step of welding said rails and corner brackets together.

6. The method of claim 4 wherein the step of applying a sealant includes brushing the sealant onto a pair of rails and corner bracket combination so as to fill up and seal any gaps therebetween.

7. The method of claim 6 wherein the step of attaching the support structure to the flat glass faceplate includes applying a frit-based cement to each of the rails and placing the rails in intimate contact with the flat glass faceplate.

8. The method of claim 7 further comprising the step of baking the faceplate, shadow mask and support structure to cure said frit-based cement.

9. The method of claim 8 wherein the step of affixing the tensioned foil shadow mask includes welding the shadow mask to its support structure.

10. The method of claim 4 wherein the sealant is a frit-based cement, and wherein said method further comprises the step of baking the faceplate, shadow mask and support structure to cure said frit-based cement.

11. In the assembly of a color cathode ray tube (CRT) having a flat glass faceplate and a tensioned foil shadow mask attached to the flat glass faceplate and maintained in a tightly stretched condition by means of a generally rectangular support structure including a plurality of elongated, generally linear rails coupled at adjacent ends therefor by means of four corner brackets, the improvement comprising:

applying a sealant to the four corners of said rectangular support structure for coating each corner bracket and coupled portions of said rails and sealing any gaps formed between a corner bracket and the rails to which the corner bracket is coupled as well as between adjacent rails to prevent a contaminant from becoming lodged in any such gaps.

* * * * *